US006691331B2

(12) United States Patent
Gallacher et al.

(10) Patent No.: US 6,691,331 B2
(45) Date of Patent: Feb. 17, 2004

(54) TOILET GASKET

(75) Inventors: Steven J. Gallacher, Chelsea, VT (US); Dwayne B. Adams, Chelsea, VT (US)

(73) Assignee: Bakup, LLC, Chelsea, VT (US)

( * ) Notice: Subject to any disclaimer, the term of this patent is extended or adjusted under 35 U.S.C. 154(b) by 0 days.

(21) Appl. No.: 10/114,213

(22) Filed: Apr. 1, 2002

(65) Prior Publication Data

US 2003/0126676 A1 Jul. 10, 2003

Related U.S. Application Data

(60) Provisional application No. 60/346,731, filed on Jan. 7, 2002.

(51) Int. Cl.[7] ..... E03D 11/16

(52) U.S. Cl. ..... 4/252.5; 4/252.6; 277/606

(58) Field of Search ..... 4/252.4, 252.5, 4/252.6; 277/606

(56) References Cited

U.S. PATENT DOCUMENTS

| | | | | |
|---|---|---|---|---|
| 696,183 A | * | 3/1902 | McAuliffe | 4/252.6 X |
| 807,265 A | * | 12/1905 | Gutelius | 4/252.4 |
| 2,750,216 A | | 6/1956 | Thies | 4/252.6 |
| 2,976,543 A | | 3/1961 | Turner et al. | 4/252.6 |
| 3,224,014 A | | 12/1965 | Pietrzak | 4/252.6 |
| 3,349,412 A | | 10/1967 | Schwartz et al. | 4/252.6 |
| 3,400,411 A | | 9/1968 | Harvey | 4/252.6 |
| 3,406,409 A | * | 10/1968 | Burns | 4/252.6 |
| 3,821,820 A | | 7/1974 | Thompson | 4/252.6 |
| 4,059,289 A | * | 11/1977 | Morris et al. | 277/606 X |
| 4,406,480 A | | 9/1983 | Izzi | 285/12 |
| 4,423,526 A | | 1/1984 | Izzi, Sr. | 4/252.5 |
| 4,470,162 A | | 9/1984 | Marshall | 4/252.5 |
| 4,482,161 A | | 11/1984 | Izzi, Sr. | 277/606 |
| 5,185,890 A | | 2/1993 | Dismore et al. | 4/252.5 |
| 2002/0166161 | * | 11/2002 | Carwile | 4/52.6 |

* cited by examiner

*Primary Examiner*—Robert M. Fetsuga
(74) *Attorney, Agent, or Firm*—Michael J. Weins; Jeffrey E. Semprebon

(57) ABSTRACT

A gasket for sealing between a toilet base a closet flange has a ring of water impermeable elastomer having a ring upper surface spaced apart from a ring lower ledge by a separation distance S sufficiently large that the ring becomes compressed between the toilet and the closet flange. The ring is sized to cover a portion of the closet flange while fitting between mounting bolts used to secure the toilet to the closet flange. The gasket also has an annular extension attached to the ring and sized to fit into the closet flange. The ring may be rectangular or trapezoidal in cross section. A preferred embodiment has a quasi-trapezoidal cross section with a groove that provides the ring with increased compressibility.

18 Claims, 8 Drawing Sheets

TOILET GASKET

FIELD OF THE INVENTION

The present invention is for a gasket which provides a seal between a base of a toilet bowl and a closet flange, and more particularly for a gasket which is simple in structure and accommodates substantial variation in the gap between the base of the toilet bowl and the closet flange.

BACKGROUND OF THE INVENTION

A seal is used between a toilet base of a toilet bowl and a closet flange, which in turn mounts on a floor. When the toilet bowl is installed, the toilet base rests on the floor, and the closet flange is positioned beneath the toilet base. The toilet bowl usually has a horn attached to the toilet base and, when the toilet is installed, the horn extends into the closet flange and directs waste and water into the closet flange when the toilet is flushed. The closet flange in turn opens into a drainpipe which connects to a sewer line that carries the waste-containing water away from the toilet. The seal prevents water from seeping through the gap between the toilet horn and the closet flange when the toilet is flushed and the closet flange is filled with waste water, and also blocks the escape of sewer gases from the drain pipe when the closet flange is not filled. The seal should also preferably prevent water seepage from occurring not only when the toilet is flushed, but also when the closet flange is subject to back pressure from the drainpipe. The elimination of sewer gases and overflow of water from the closet flange improves sanitation and prevents water damage to the surrounding floor.

Classically, the seal has been provided by a ring of soft deformable wax. The wax seal is designed to have an opening sufficient to accept the horn on the base of a conventional toilet. The wax seal is also chosen to be pliable enough that, when compressed between the toilet base and the closet flange when the toilet base is secured with respect to the closet flange by mounting bolts, the compression of the wax seal deforms the ring to the contour of the toilet base and the closet flange, creating a seal therebetween when the base rests on the floor. However, these seals may be subject to loads during assembly which can cause deformations that distort the ring and can result in the ring failing to seal the toilet base with respect to the closet flange when the toilet base rests on the floor. For example, deformation caused when setting the toilet base onto the floor can cause damage to the ring by distorting its profile, thereby resulting in unsealed regions of the toilet base with respect to the closet flange. The properties of these wax seals are also strongly temperature dependant, and can result in thermal creep over time which can eventually result in leakage. The problems associated with thermal creep are particularly troublesome in buildings with radiant heating installed into the floor, since the resulting heat in the floor can accelerate creep and, in some cases, could result in at least partial melting of the seal. The problem of melting when subjected to high temperatures can also create problems when wax seals are stored in an environment where the temperature is elevated. An additional problem with wax seals is their lack of elastic deformation, which limits the ability of the seal to conform to irregularities in the contour of the toilet bowl base, which can contribute to leakage. Furthermore, if the toilet is rocked or shifts over time, the seal may pull away from either the toilet base, the horn, or the closet flange.

Many attempts to overcome the shortcomings of the wax seal have been tried. Many other materials, including rubber gaskets and foam rings have been tried as substitutes for the wax seal, but none have met with success. The rubber materials are reported to tend to pull away from the surfaces over time. Foam rings provide elastic behavior and are better able to conform to any irregularities, but foam materials are permeable, allowing the seal to be penetrated in time, and are highly subject to deterioration over time. One attempt to overcome these problems has been to fill the cells of the foam with wax, as taught in U.S. Pat. No. 3,400,411; however, this solution has proven to be less than satisfactory. The wax-filled foam is still liable to set once in place, resulting in leakage if the toilet is rocked or shifted. Even if the foam retains sufficient resiliency to compensate for shifting, the wax in the cells will tend to remain in its deformed state, and may create paths for water to permeate through the seal.

Various other devices have attempted to overcome the problem of providing a seal. Such devices are taught, for example, in U.S. Pat. Nos. 2,750,216; 2,976,543; 3,224,014; 3,349,412; 3,400,411; 3,821,820; 4,423,526; 4,482,161; and 5,185,890.

U.S. Pat. No. 2,750,216 teaches one attempt to overcome the deficiencies of wax and sponge rubber seals by employing a ring gasket of wax or sponge rubber with a tapered sleeve or ferrule extending downwardly therefrom. The upper end of the ferrule has a flange which engages an annular slot in the ring, while the lower end of the ferrule extends into the drain and is sized to be spaced away from the sidewall of the drain to prevent leakage through capillary action. U.S. Pat. Nos. 2,976,543; 3,224,014; 3,349,412; 3,400,411; and 3,821,820 teach similar seals which employ ferrules.

Another attempt to overcome the problems due to lack of resiliency in wax seals is taught in U.S. Pat. Nos. 4,423,526 and 4,482,161, which teach reusable gaskets formed of "memory material", such as rubberlike PVC, which are compressed between the toilet horn and the closet flange. The gaskets of the '526 patent have a disk which extends over the entire surface of the closet flange, having holes for receiving the toilet bolts. The gasket of the '161 patent, which is a CIP of the '526 patent, has a sealing ring portion for sealing between the toilet horn and the closet flange, and a surrounding sheet-like web portion which covers the closet flange and has concentric ridges for sealing between the toilet base and the closet flange. The '161 patent also teaches a preferred hardness of the "memory material" of durometer 60 (Shore A±5). While these patents teach a reusable seal, neither provides for a universal seal which can be used where the gap between the toilet horn and the closet flange differs significantly from one installation to another. Furthermore, since the contact area is large, the pressure on the seal will be small and effectiveness of the seal is due in part to the large area of the seal. However, when the flange surface is tilted with respect to the floor, this tilt reduces the effective contact surface and thus the sealing area. In which case, seepage can result if the sewer line backs up, creating a head of waste water above the seal.

U.S. Pat. No. 5,185,890 is designed to overcome the problem of accommodating variation in height between the toilet horn and the closet flange which may occur in various installation situations. The invention of the '890 patent accommodates variation in height by employing a semi-rigid funnel which is adhered to the toilet bowl to form an extension of the horn, and a sealing ring of neoprene-like material configured to be compressed between the funnel and the closet flange. The sealing ring either extends to substantially cover the closet flange, having bolt holes, or may be adhered to the closet flange. While this seal may overcome the problem of variation in the separation between the toilet horn and the closet flange in various installations, it requires a more complex structure and creates a protrusion which extends below the base of the toilet, with the result that the toilet cannot be rested on its base unless there is a hole for receiving the funnel.

Thus, while may seals have been developed to overcome the shortcomings of the wax seal, they have at best been only partly successful, and for this reason have not met with great commercial success. Despite its known deficiencies, the wax seal remains the standard.

Thus, there is a need for a toilet bowl gasket which overcomes the deficiencies set forth above while maintaining a simplified structure and ease of use.

SUMMARY OF THE INVENTION

The present invention is a gasket for placement between a toilet base, having a horn attached thereto, and a closet flange, having a central opening that is bounded by a central opening sidewall which intersects and terminates at a substantially planar flange upper surface. In practice, the closet flange may be set with the flange upper surface at substantially different heights relative to the floor on which the toilet base is to rest. Typically, the closet flange has a central plastic portion, containing the central opening and at least a portion of the flange upper surface, and a surrounding metal portion which mounts to the floor or an underlying subfloor. The toilet base in turn is held in position on the floor with mounting bolts which couple the closet flange to the toilet base. The mounting bolts are spaced apart by a bolt distance $D_b$.

The gasket of the present invention has a ring having a ring diameter $D_r$ which is less than the bolt distance $D_b$. The ring is fabricated from a water impermeable elastomer having a hardness of less than about durometer 50 (Shore±5). An elastomer is chosen which is resilient to provide a material with a memory so that, if it is subjected to a variation in its state of compression, it will expand and contract in accordance with the pressure to provide a seal at all times. The elastomer may be either a fully dense material, defined herein as a material which is substantially free of distributed cavities or voids, or a closed cell foam, since either can provide a water impermeable elastomer. The ring has a substantially planar ring upper surface which is spaced apart from a substantially planar ring lower ledge by a separation distance S. The term "substantially planar" as used herein is intended to include planar surfaces, gently curving surfaces, or undulating surfaces where the height differences are sufficiently small that, when the surfaces are in service, there are no interconnected paths that transverse these surfaces. The separation distance S is selected to be sufficiently large that the material between the ring upper surface and the ring lower ledge is compressed when the toilet is installed on the closet flange with the ring interposed therebetween.

The compressive load applied when the toilet is mounted to the closet flange should compress the gasket material of the ring sufficiently to create a seal between the toilet base and the closet flange when the toilet base rests on the floor. Since the gasket is resilient, it can accommodate irregularities in the surfaces on which it resides and expand to forcibly conform to these irregularities. The resilient character of the material also allows the ring to accommodate variations in the height of the flange upper surface with respect to the floor. It is preferred that the separation distance S be at least about ½ inch (13 mm) to assure compression of the ring when the toilet base is drawn down to the floor in situations where the closet flange is mounted on a subfloor. The combination of having S of at least about ½ inch (13 mm) and the ring diameter $D_r$ restricted to less than the bolt separation $D_b$ enhances the ability of the gasket to accommodate for tilt between the floor and the flange upper surface.

The ring is further bounded by a ring inner surface and a ring outer surface, which is spaced apart from the inner surface. The ring inner surface is configured to surround a portion of the horn of the toilet base when the horn is placed within the ring, and preferably conforms to the contour of the horn. The ring outer surface defines the ring diameter $D_r$.

The ring may be formed as a cylinder having a substantially rectangular cross section and a thickness T. In such cases, when the thickness T of the nearly cylindrical ring shape is maintained at less than about ¼ inch (6 mm) and the ring is fabricated from materials having a hardness of less than about durometer 50 (Shore A±5), it is preferred that the separation distance S not be greater than about 0.9 inch (23 mm). This limit of the separation distance S avoids having the compressive loads needed to bring the toilet base into contact with the floor so large as to cause a risk of fracturing the ceramic toilet base before the toilet base is drawn down to the floor. At greater thicknesses of about ⅜ inch, the hardness of the ring should be reduced to about durometer 35 (Shore A±5) and the maximum height should be restricted to about 0.8 inch (20 mm).

While essentially cylindrical rings can be employed, it is preferred for the ring outer surface to converge sightly as it approaches the substantially planar ring upper surface, making the cross section of the ring trapezoidal in character. This shape is preferred if the ring is to be injection molded, since it facilitates release of the ring from the mold and allows fully dense materials to be formed. A trapezoidal cross section with a large base is further preferred, since it enhances the buckling strength of the ring. When rings are employed that have a trapezoidal cross section designed to enhance the buckling strength, the ring should have a minimum thickness $T_{min}$ at the ring upper surface which is no greater than about 85% of a maximum thickness $T_{max}$ which occurs at the ring lower ledge. The ring is preferably configured such that $T_{max}$ is at least about ½ of the separation distance S, and more preferably that $T_{max}$ be about the value of the separation distance S to add to stability of the ring when compressed.

Since rings with trapezoidal cross sections are generally more massive than cylindrical rings, and thus it is again preferred that the maximum separation distance S be limited to at most about 0.8 inches (20 mm) to reduce the compression forces required to seat the toilet with respect to the floor. For rings having a separation distance S near the top of this range, it is preferred for the ring to be fabricated from material having a hardness below a durometer of 35 (Shore A±5) and preferably lower. For a molded multi-part ring, a practical lower limit is a durometer of 25, since softer materials can not be readily withdrawn from the mold in which they are formed without ripping. The ring can be formed with a solid trapezoidal cross section or, as discussed in greater detail below, the ring can have a multi-component structure which forms an overall trapezoidal cross section. While solid trapezoidal rings are effective in providing a seal, they have been found to require expertise in installation to avoid fracturing the toilet base unless compensation can be made for the increased cross section of the ring.

The gasket also has an annular extension which is attached to and protrudes from the ring lower ledge, and which is preferably formed as an integral part of the ring. The annular extension has an extension outer surface extending from the ring lower ledge and configured to be insertable into the central opening of the closet flange such that, when so inserted, the ring lower ledge abuts the flange upper surface. The annular extension preferably has a vertical extent less than the separation distance S of the ring.

An extension inner surface is spaced apart from the extension outer surface and preferably continuously extends the ring inner surface so as to avoid any discontinuity between the two which might collect waste matter. When the annular extension is inserted into the central opening of the closet flange, the ring lower ledge rests against the flange upper surface. Preferably, the extension outer surface is closely matched in size to the central opening of the closet flange, so that the annular extension engages the central opening to maintain the gasket centered thereon during installation of the toilet base. It is preferred for the extension outer surface to be slightly tapered, narrowing as the distance of the surface from the substantially planar ring lower ledge increases, so as to facilitate insertion of the annular extension into the central opening while assuring contact with the central opening sidewall in the vicinity of the flange upper surface. The tapered profile also provides a benefit when the gasket is to be fabricated by molding, since it provides draft to facilitate removing the gasket from the mold. When the gasket is to be molded, the extension inner surface is preferably also tapered, but with a reversed taper to the taper of the outer surface, and is preferably also contoured to be substantially continuous with the ring inner surface of the ring to avoid forming a discontinuity in the surface, as noted above.

Where resistance to water pressure resulting from a back-up of a sewer line creating a head of water above the seal is critical, such as for applications where the toilet is subject to backfilling by a sewer line back-up, a high buckling strength is advantageous to assure a seal is maintained. For such applications is preferred to employ a ring having greater effective buckling strength without an associated increase in the stiffness of the material of the ring which could result in fracture of the toilet base during installation. It is also preferred that ring be capable of providing a greater component of the pressure resulting from compression of the ring to be applied to the horn of the toilet base. Such increased buckling strength can be provided by employing a rigid support sleeve in combination with a thin cylindrical ring, or alternatively by employing a multi-component quasi-trapezoidal ring in the gasket. This quasi-trapezoidal ring has a cross section that is essentially trapezoidal, with a groove extending upward from the substantially planar ring lower ledge.

The multi-component ring structure is the preferred structure, since it is an integrated unit which simplifies installation and because it can accommodate a greater range of deformations than do gaskets employing a rigid support sleeve. Furthermore, for similar hardness of the material from which the rings are fabricated, the multi-component rings provide a greater range of deformation than the equivalent sized solid ring having a trapezoidal cross section.

The multi-component structure has an upper continuous region, an inner diverging leg that forms an inner hoop having an inner surface which forms part of the ring inner surface, and an outer diverging leg that forms an outer hoop having an outer surface which forms part of the ring outer surface. These surfaces form the non-parallel sides of the trapezoidal cross section of the ring. The inner diverging leg and the outer diverging leg of the ring are spatially arranged with the upper continuous region extending downwardly from the substantially planar ring upper surface, having attached thereto the inner diverging leg and the outer diverging leg. The inner diverging leg terminates at an inner leg free end which forms an inner part of the substantially planar ring lower ledge. Similarly, the outer diverging leg terminates in an outer leg free end which forms an outer part of the substantially planar ring lower ledge. The inner diverging leg and the outer diverging leg are separated by a groove having a substantially triangular cross section with a groove depth D and a groove breadth B which separates the inner part and the outer part of the substantially planar ring lower ledge.

It is further preferred that the ratio of the groove depth D be maintained between about 60% and 80% of the separation distance S. The lower limit assures sufficient compressibility of the ring, while the upper limit assures sufficient strength of the multi-part structure. It is also preferred that the groove breadth B be maintained between 30% and 40% of the groove depth D, and that the inner diverging leg have a mean thickness $t_{inner}$ which is greater than the mean thickness $t_{outer}$ of the outer diverging leg. Preferably, the mean thickness $t_{inner}$ of the inner diverging leg is 50% to 60% greater than the mean thickness $t_{outer}$ of the outer diverging leg. It is also preferred that the outer diverging leg have a thickness $t_{outer}$ of at least about 3/16 inch (5 mm) and more preferably ¼ inch (6 mm), so as to provide significant additional support for the substantially planar ring upper surface as well as increased pressure of the ring inner surface against the horn. Both of these enhance the sealing capacity of the ring; however, this is accomplished by a loss in the deformability of the resulting ring when compared to a ring which lacks an outer diverging leg.

It is further preferred for the substantially planar ring upper surface to be provided with a concentric indentation. The concentric indentation provides the upper surface with greater deformability to better conform to the contours of the toilet base and can also be used for locating a bead of caulk or similar sealant to further assure a seal between the ring and the toilet base.

BEST MODE FOR CARRYING THE INVENTION INTO PRACTICE

Figure 1:
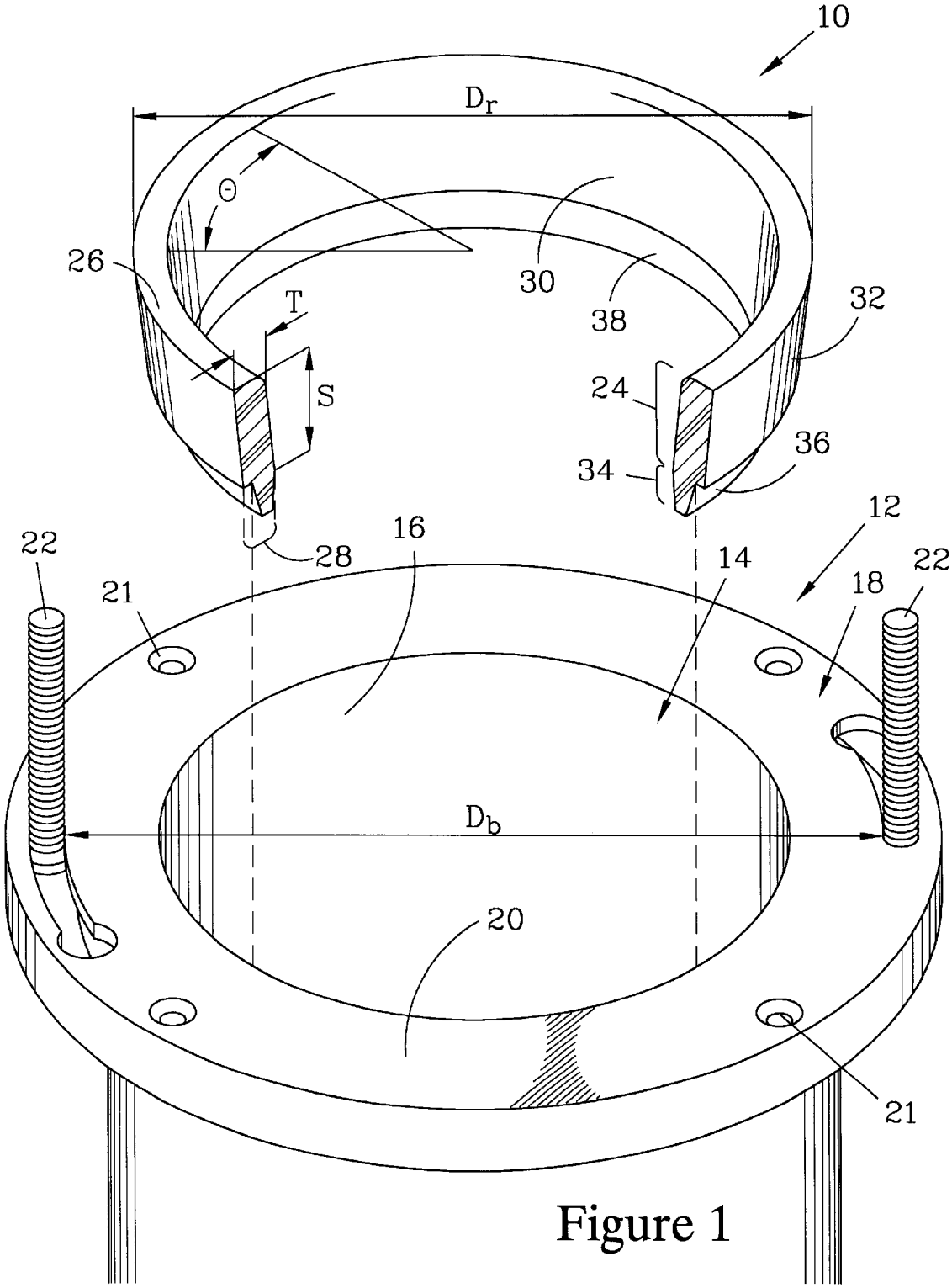
FIG. 1 is an isometric view of a gasket, which forms one embodiment of the present invention, and a closet flange onto which it is set, the closet flange being mounted to a floor (not shown). The closet flange illustrated has a central opening with a central opening sidewall which intersects with and terminates at a flange upper surface. The gasket has a ring which is substantially rectangular in cross section with the smaller pair of sides serving as a substantially planar ring upper surface and a substantially planar ring lower ledge. These surfaces are separated by a separation distance S which is larger than the length of the smaller pair of sides. The ring has an annular extension extending from the ring lower ledge. When the gasket is set, the ring of the gasket rests on the flange upper surface, and the annular extension engages the central opening sidewall of the central opening, thereby stabilizing the gasket and maintaining it axially aligned with the central opening as a toilet (not shown) is installed.

FIG. 1 is an isometric view of a gasket 10 which forms one embodiment of the present invention. The gasket 10 is designed to provide a seal between a closet flange 12 over which it is set and a toilet having a toilet base (not shown). The closet flange 12 has a central opening 14 bounded by a central opening sidewall 16, which is substantially vertical and passes through a flange 18 having a substantially planar flange upper surface 20. The flange 18 in turn is mounted to a floor or subfloor (not shown). The flange 18 has anchoring passages 21 therethrough, for anchoring the flange 18 to the floor or subfloor with screws or similar fasteners. Mounting bolts 22 are mounted to the flange 18 and are separated by a bolt distance $D_b$. The mounting bolts 22 attach to the toilet base (not shown) for securing the toilet base to the floor. Further details of securing the toilet base are set forth in the discussion of FIGS. 5 and 6.

The gasket 10 has a ring 24 which is fabricated from a water impermeable elastomer having a hardness of less than about durometer 50 (Shore±5). An elastomer is chosen which is sufficiently resilient as to provide a material with a memory. Thus, if the ring 24 is subjected to a variation in its state of compression, the ring 24 can expand and contract accordingly to provide a seal at all times, preventing leakage if the toilet is rocked or shifted over time. The elastomer may be either a fully dense material or a closed cell foam. If the ring 24 is injection molded from an elastomer such as neoprene, the resulting ring 24 will be fully dense, substantially without distributed cavities. Alternatively, the ring 24 can be fabricated from a closed cell foam. The ring 24 has a ring diameter $D_r$, which is less than the bolt separation distance $D_b$ of the mounting bolts 22. The ring 24 has a substantially rectangular cross section and is bounded by a substantially planar ring upper surface 26 and a substantially planar ring lower ledge 28 which form the shorter sides of the substantially rectangular cross section. These sides are parallel to each other and spaced apart from each other by a separation distance S. This separation distance S is greater than the distance between the closet flange 12 and the toilet base when the toilet is positioned over the closet flange 12 and is secured with respect to the floor. The separation distance S should have a minimum value of about ½ inches (13 mm) to assure that the ring 24 of the gasket 10 is compressed when the toilet is set since, under most circumstances, the separation between the flange upper surface 20 and the toilet base when the toilet base is secured with respect to the floor will be less than ½ inches (13 mm) when the flange 18 is mounted on the floor. Providing the separation distance S also allows for accommodation between the closet flange 12 and the toilet base in the event that the flange upper surface 20 is not parallel with respect to the floor. The separation distance S should also be limited to less than about 0.9 inches (23 mm) to avoid stresses which could cause fracture of the toilet base when it is drawn down on the mounting bolts 22. Alternatively, a greater separation distance S could result in buckling of the ring 24, thereby reducing the sealing area and limiting the effectiveness of the gasket 10.

The ring 24 is further bounded by a ring inner surface 30, which in this embodiment is quasi-cylindrical in nature and configured to surround a portion of a horn of the toilet which extends into the central opening 14 of the closet flange 12, and a ring outer surface 32, which in this embodiment is substantially cylindrical in form. The ring inner surface 30 and the ring outer surface 32 define the longer pair of sides of the substantially rectangular cross section of the ring 24, and are spaced apart by a substantially constant ring thickness T.

In this embodiment, the ring thickness T is relatively small, and typically less than about ¼ inch (6 mm). Maintaining a relatively small thickness T and a substantial separation distance S allows the gasket 10 to accommodate a variation in the compressed height of the ring 24 as a function of the angular position 0 without giving rise to large compressive stresses in the event that the flange upper surface 20 is not parallel to the floor on which the toilet base rests. This allows the gasket 10 to compensate for the divergence between the floor and the substantially planar upper surface 20 of the flange 18. Such divergence cannot be readily compensated for by the gaskets taught in U.S. Pat. Nos. 4,423,526 and 4,482,161, since the gaskets disclosed in these patents are disks which cover the entire substantially planar flange upper surface of the flange. These gaskets maintain a leak-free surface between the flange upper surface and the disk as well as between the toilet base and the disk by assuring that there are no gaps between the gasket and the flange upper surface or between the gasket and the toilet base. To prevent such gaps in cases where the flange is tilted with respect to the floor would require large loads which might or might not be effective in bringing the surfaces of the gasket into sealable engagement with the substantially planar flange upper surface and the toilet base when these elements are not parallel.

When the ring thickness T of the ring 24 is so limited and the hardness of the material is maintained below about 50 durometer (Shore A±5), the ring 24 should be capable of a reduction of the separation distance S sufficient to draw the toilet base into contact with the floor without raising the stress on the toilet base to an extent which is likely to result in fracturing the toilet base.

The gasket 10 is provided with an annular extension 34, which can be formed integrally with the ring 24 and forms a protrusion on the ring lower ledge 28 when the ring 24 is injection molded. Alternatively, when the gasket 10 is formed from a closed cell foam, the ring 24 and the annular extension 34 are preferably formed as separate elements and bonded together. This latter fabrication technique allows the gasket 10 to be fabricated from a closed cell foam material, since molding of such materials is not practical. The annular extension 34 has an extension outer surface 36 which extends from the ring lower ledge 28 and is configured so as to be insertable into the central opening 14. The annular extension 34 is also bounded by an extension interior surface 38, which is spaced apart from the extension outer surface 36 and preferably extends the ring inner surface 30 in a substantially continuous manner. The substantially planar ring lower ledge 28 of the gasket 10 rests on the flange upper surface 20 of the closet flange 12 when the annular extension 34 engages the central opening sidewall 16 of the central opening 14, thereby stabilizing the gasket 10 as the toilet is set into place.

Figure 2:
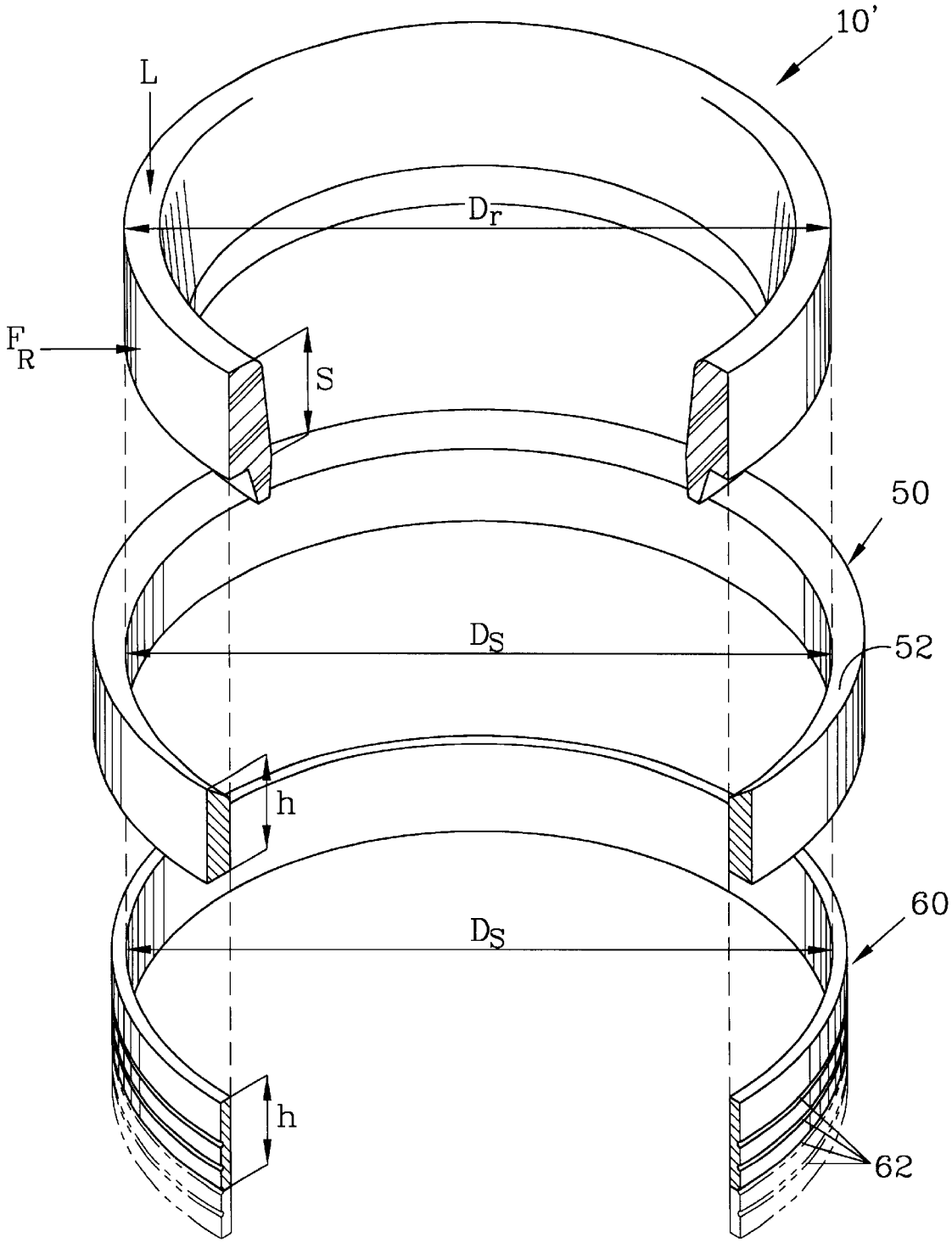
FIG. 2 illustrates another embodiment of the invention where a rigid support sleeve of height h, which is less than a separation distance S, is provided. The sleeve height h is set in view of the position of the closet flange with respect to the floor. The rigid support sleeve can be preformed to have the height h tailored to a particular need. Alternatively, a preformed support sleeve is also shown which is a tube that can be cut to a desired height h as needed. The tube has marks to indicate various increments of the height h. When the marks are notches, they help guide the cutting process.

FIG. 2 illustrates a supplemental rigid support sleeve 50 that can be used in combination with the gasket 10', which has an outer ring diameter $D_r$ and is essentially similar in structure to the gasket 10 shown in FIG. 1. The rigid support sleeve 50 has an internal sleeve diameter $D_S$ which allows it to be slid over the gasket 10' and, when so positioned, to provide a reaction force $F_R$ responsive to the load L resulting from seating the toilet base on the gasket 10'. The reaction force $F_R$ serves to radially compress the gasket 10', directing it toward the horn of the toilet base. The height h of the support sleeve in all cases is less than the separation distance S, and may need to be substantially smaller in the event that the flange upper surface of the closet flange is raised above the level of the floor of the room. It is also preferred to provide a beveled upper edge 52 to the support sleeve 50 to aid in directing the gasket 10' into the rigid support sleeve 50 as it is compressed.

A series of individual rigid support sleeves 50 can be provided in incrementally differing heights h, such as represented by the single rigid support sleeve 50 illustrated. The toilet installer can then select the support sleeve 50 having the desired height h appropriate for the particular installation. Alternatively, variation in the height of the floor with respect to the flange upper surface of the closet flange can be accommodated by employing an alternate rigid support sleeve 60 to surround the gasket 10'. The alternate rigid support sleeve 60 can be cut to length at the site prior to the installation of the toilet to achieve a desired height h. For the convenience of the installer, it is preferred to have marking notches 62 on the exterior surface of the alternate rigid support sleeve 60 to provided a convenient way of determining the length to be cut without the need of a measuring device. The notches also serve to stabilize a saw blade as it is used to cut the alternate rigid support sleeve 60 to the appropriate height h.

Figure 3:
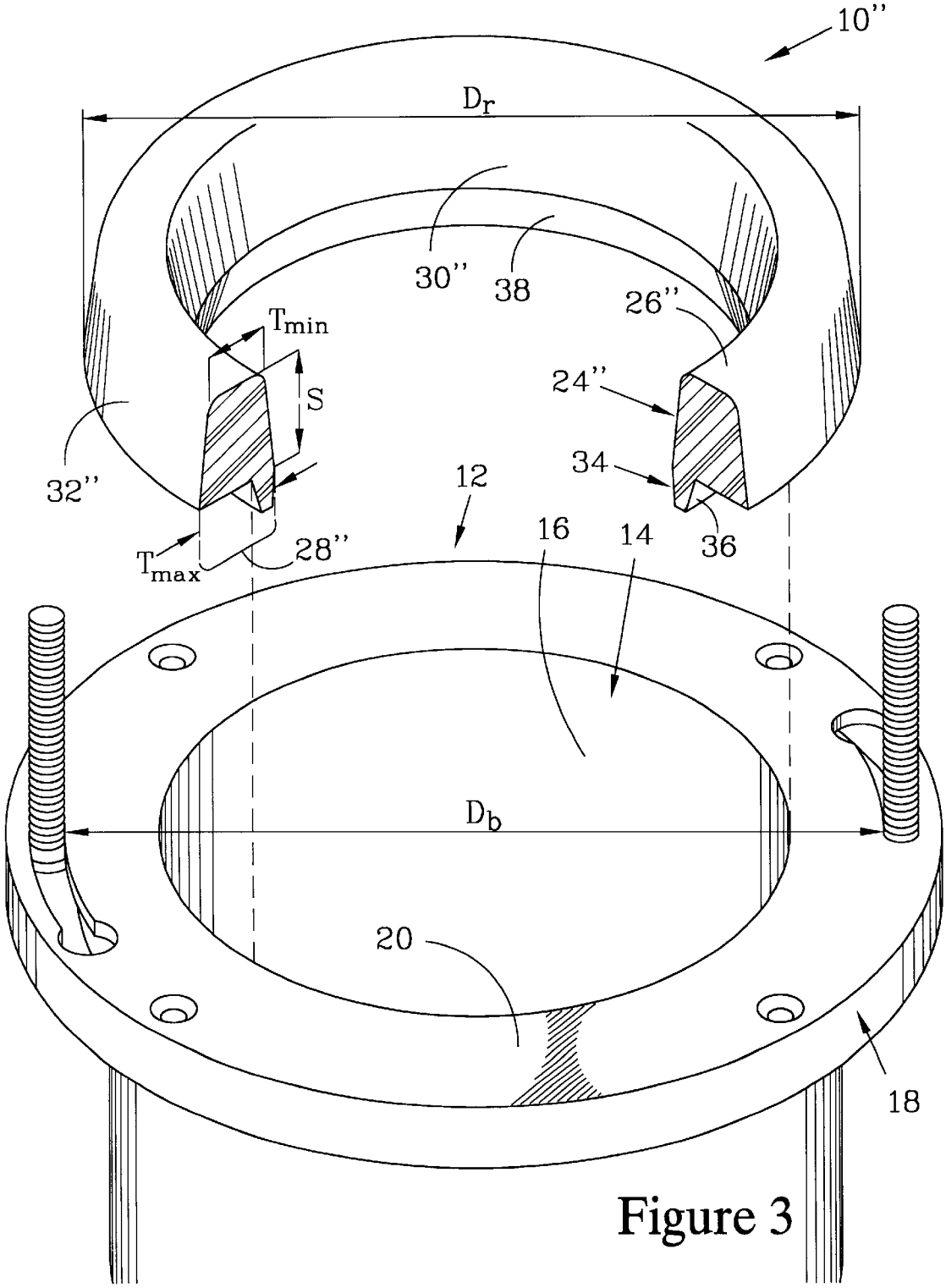
FIG. 3 is an isometric view of another gasket, which forms another embodiment of the present invention, and a closet flange onto which it is set. In this embodiment, the gasket has a ring which differs from the ring illustrated in FIG. 1 in that its cross section is quasi-trapezoidal, with the smaller of the parallel sides serving as the substantially planar ring upper surface and the larger of the parallel sides serving in part as the substantially planar ring lower ledge. In this embodiment, the separation distance S is comparable to the maximum ring thickness $T_{max}$.

FIG. 3 illustrates a gasket 10" which shares many features in common with the gasket 10 discussed above, and again has a ring 24" having a ring diameter $D_r$, which is less than the bolt separation distance $D_b$. Again, it is preferred for the material from which the ring is constructed to be a solid rather than a closed cell foam, which also facilitates fabrication of the gasket 10" by injection molding. The gasket 10" differs in the details of the cross section of the ring 24". In this embodiment, the cross section is essentially trapezoidal, rather than rectangular. The trapezoidal cross section further facilitates fabricating the ring 24" by injection molding, since it facilitates release of the ring from the mold. The ring 24" is bounded by a substantially planar ring upper surface 26" which defines the smaller of the parallel edges of the trapezoid, and a substantially planar ring lower ledge 28" which defines the larger parallel side of the trapezoid.

Since the ring 24" is trapezoidal in cross section, the thickness T between a ring inner surface 30" and a ring outer surface 32" varies from a maximum value $T_{max}$ at the ring lower ledge 28" to a minimum value $T_{min}$ at the ring upper surface 26". Preferably, the trapezoidal cross section is shaped such that the minimum thickness $T_{min}$ at the ring upper surface 26" is no greater than about 85% of the maximum thickness $T_{max}$ at the ring lower ledge 28". $T_{max}$ in turn is preferably at least as great as about 80% of the separation distance S. It is further preferred for the values of the separation distance S and the maximum thickness $T_{max}$ of the ring 24" to be about equal. The trapezoidal shape and its positioning increase the stability of the ring 24" with respect to buckling, but do so at the expense of increasing the mean value of the thickness T of the ring 24", and thus the force needed to compress the ring 24" to reduce the separation distance S. For this reason, it is preferred for the ring 24" to be fabricated from a material which is softer, preferably having a durometer hardness of less than 35 (Shore A±5). Again, with this configuration, alignment of the floor with the flange upper surface 20 is not critical, since there is a substantial separation distance S to accommodate variation in the separation between the flange 18 and the toilet base when the toilet base rests on the floor.

Figure 4:
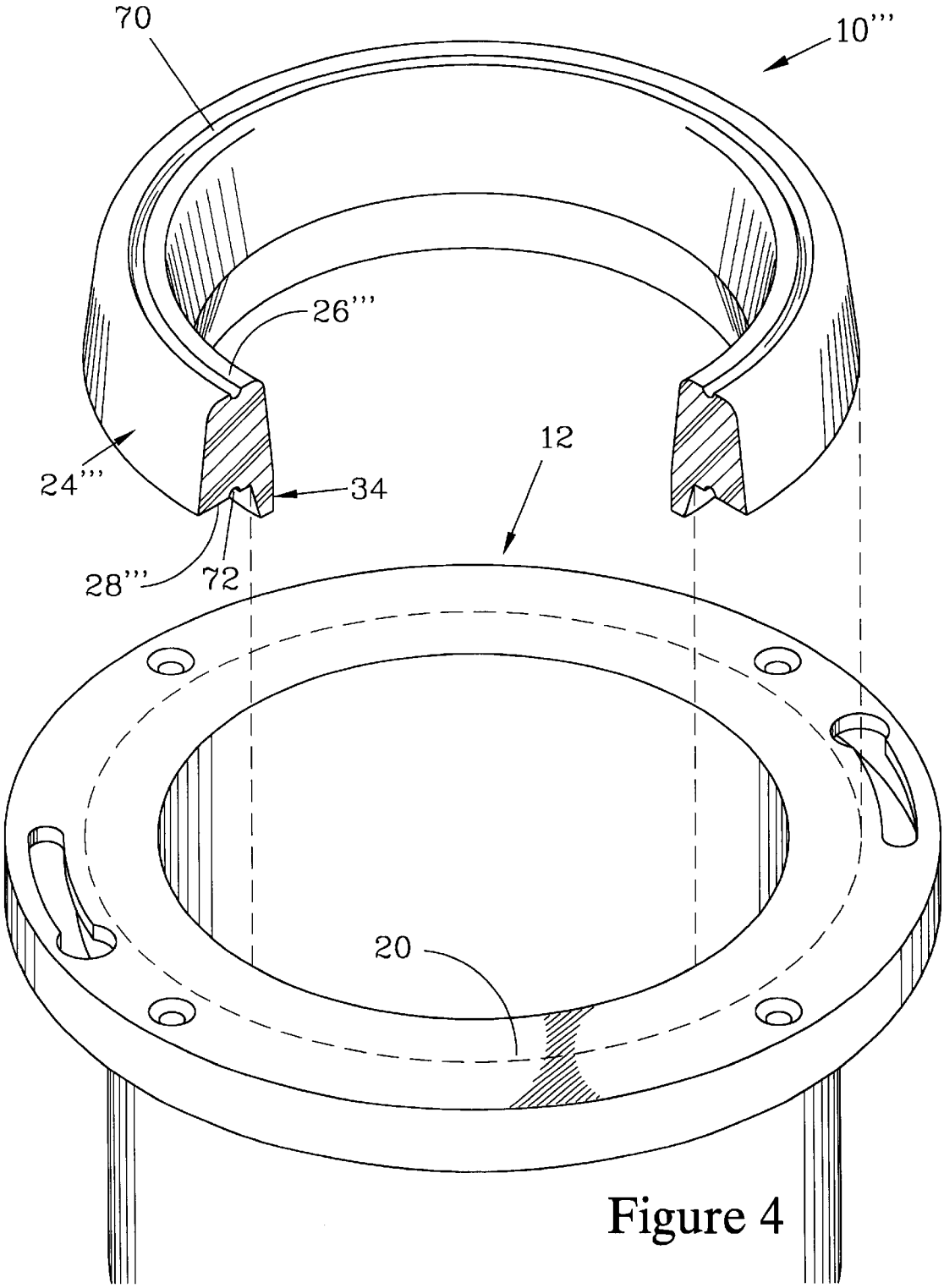
FIG. 4 is an isometric view of an embodiment similar to the embodiment shown in FIG. 3, but which is provided with a concentric upper indentation and a concentric ring indentation, which reside respectively in a substantially planar ring upper surface and a substantially planar ring lower ledge. These indentations provide additional flexibility on these surfaces to further aid in the sealing of these surfaces respectively to a toilet base and to the flange upper surface.

FIG. 4 illustrates a gasket 10'" which shares many features in common with the gasket 10" discussed above. The gasket 10'" differs in that it has a ring 24'" which is provided with an upper indentation 70, provided in the substantially planar upper surface 26'", and a lower indentation 72, provided in the ring lower ledge 28'". These indentations (70, 72) provide greater ability to deform, allowing the substantially planar upper surface 26'" and the ring lower ledge 28'" to better conform to the surfaces with which they mate.

Figure 5:
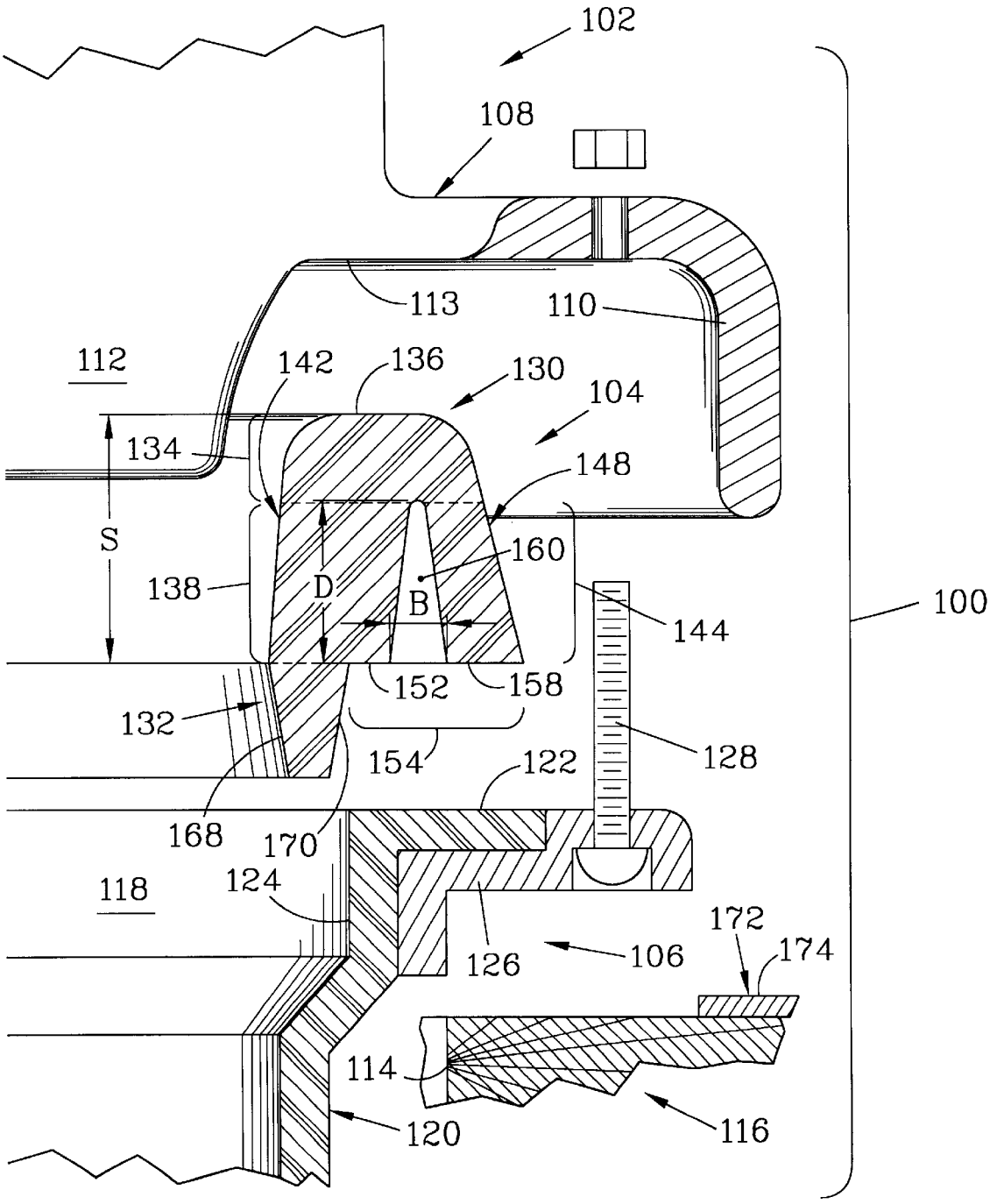
FIG. 5 is a partial exploded section view of a toilet base, a gasket of another embodiment of the present invention, and an associated closet flange. The exploded view illustrates the parts in the preassembled condition. Both the closet flange and the gasket differ from those shown in FIGS. 1, 3 and 4. The closet flange illustrated is a two-part flange having a central section which is fabricated from plastic surrounded by a metal rim extension for mounting to a subfloor underlying a floor on which the toilet base is to be supported. The metal rim extension also holds mounting bolts which secure the toilet base to the closet flange and the floor. The gasket of this embodiment also differs from the gaskets shown in FIGS. 1, 2, 3 and 4 in that it employs a multi-component ring which enhances deformability of the ring to allow greater variations in the relative positions of the floor, the closet flange, and toilet base when assembled.
Figure 6:
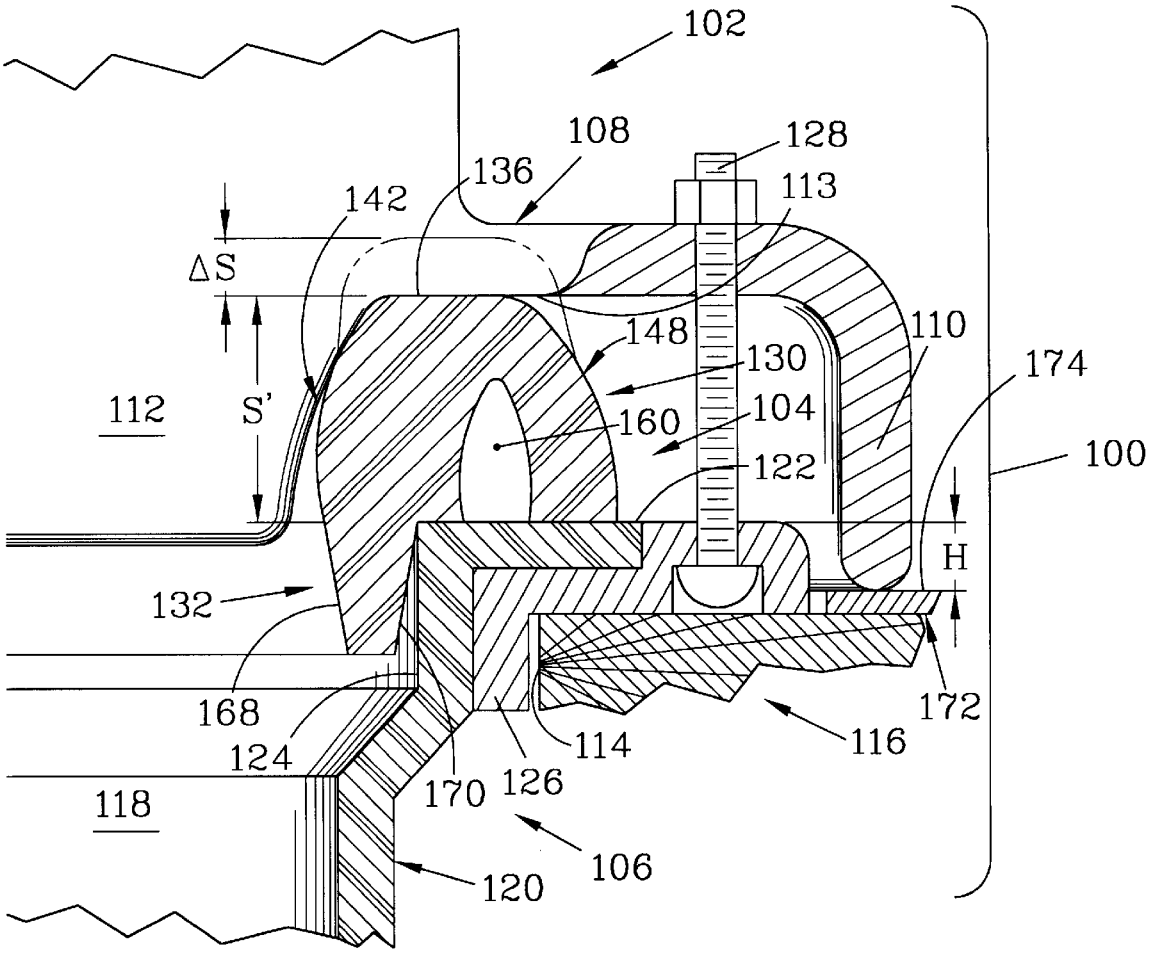
FIG. 6 is a partial section view of the elements shown in FIG. 5, showing their spacial relationship when the toilet is seated on the closet flange and drawn so that the toilet base rests on the floor. When the toilet is seated on the closet flange and rests on the floor, the ring of the gasket is compressed between the toilet base and the closet flange as illustrated.
Figure 7:
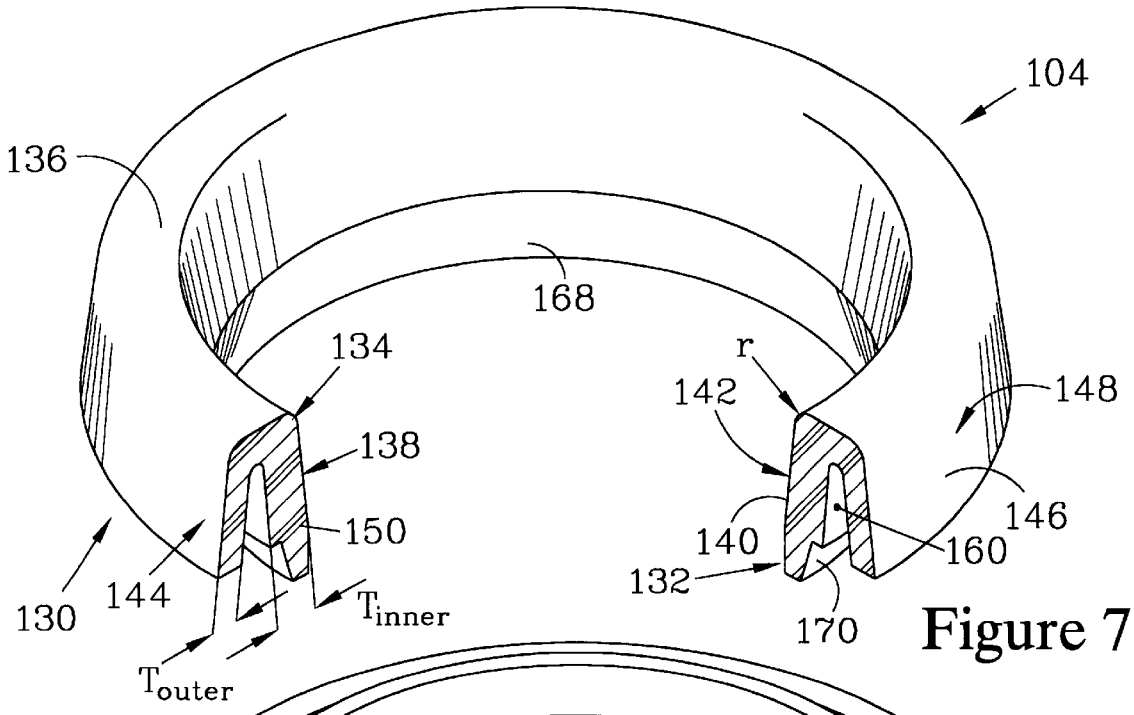
FIG. 7 is an isometric view of the gasket shown in FIG. 5 viewed from the top, with the ring upper surface facing upward.
Figure 8:
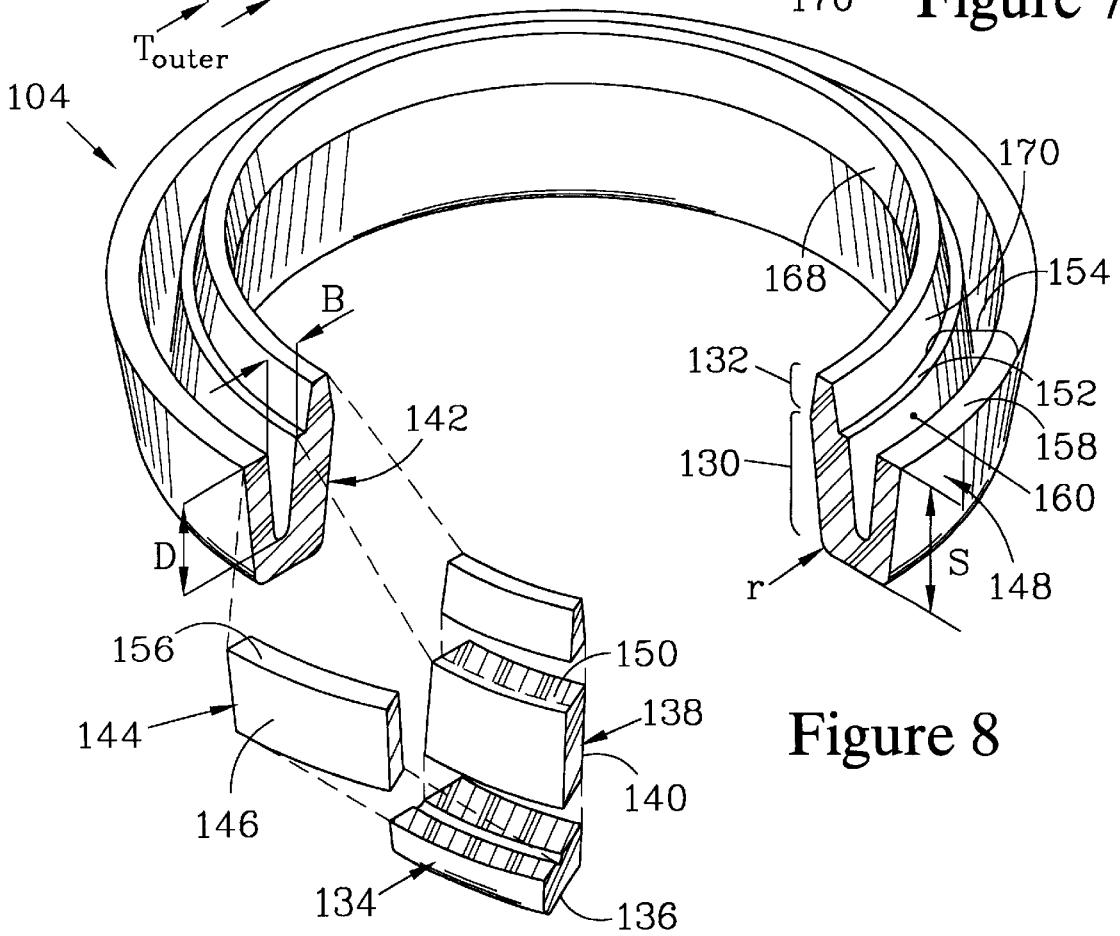
FIG. 8 is an isometric view of the gasket shown in FIG. 5 viewed from the bottom, with the ring lower ledge facing upward.

FIGS. 5 and 6 are partial section views of a toilet, gasket, and closet flange assembly 100. The assembly 100 has a toilet 102 which is positioned above a gasket 104 which in turn resides above a closet flange 106. While the gasket 104 differs from the gaskets 10, 10', 10", and 10'" discussed above, those gaskets (10, 10', 10" and 10'") might also be used in an assembly similar to the assembly 100. FIG. 5 illustrates the assembly 100 in exploded form, where the gasket 104 is in an undeformed condition. FIG. 6 illustrates the assembly 100 in its assembled configuration, where the gasket 104 is deformed by compression between the toilet 102 and the closet flange 106. FIGS. 7 and 8 are isometric views of the gasket 104 with a section broken out to show details of the cross section as well as some internal surfaces.

Referring to FIGS. 5 and 6, the toilet 102 has a toilet base 108 which includes a skirt 110, which supports the toilet 102 when installed, and a horn 112 surrounded by a substantially planar toilet lower surface 113. For the assembly 100 illustrated, the closet flange 106 shown is a two-part structure which is designed to straddle a hole 114 in a subfloor 116. The closet flange 106 has a central opening 118 in a plastic central portion 120 which also forms a portion of a flange upper surface 122. The central opening 118 is bounded by a substantially vertical central opening sidewall 124. Engaging the central portion 120 is a metal flange extension 126 in which mounting bolts 128 (only one of which is shown) are mounted, and anchoring passages (not shown) are provided for attaching the closet flange 106 to the subfloor 116. Having the metal flange extension 126 increases the strength of the closet flange 106 while providing plastic surfaces for coupling to a drainpipe (not shown). Since such drainpipes are currently fabricated of plastic, the plastic central portion 120 facilitates joining the closet flange 106 with the drainpipe and related plumbing.

FIG. 5 illustrates the gasket 104 in its undeformed state. The gasket 104 provides a gasket design which has superior resistance to water pressure compared to the gaskets 10 and 10' and is particularly well suited for installations where the toilet 102 may be subject to backfilling by sewer line back-up. In fact, per unit pressure exerted by the toilet 102 when drawn down by tightening of the mounting bolts 128, the gasket 104 will have greater resistance to seal breakdown than the gasket 10" or the gasket 10'". Thus, the gasket 104 provides an excellent combination of deformability and sealing capacity which makes this design particularly attractive.

The gasket 104 is again formed by a ring 130 and an annular extension 132. The ring 130 of this embodiment differs from the earlier described rings 24, 24', 24", and 24'" in that it has a multi-component structure which is best illustrated in FIGS. 7 and 8, which are isometric views of the gasket 104 with a section broken out. The multi-component character of the ring 130 is responsible for the enhanced performance of the gasket 104, and has a quasi-trapezoidal cross section. The quasi-trapezoidal cross section preferably has an overall geometry similar to that of the substantially trapezoidal cross section of the ring 24" discussed above and shown in FIG. 3. The multi-component ring 130 has an upper continuous region 134, which extends downward from a substantially planar ring upper surface 136. An inner diverging leg 138 is attached to the continuous region 134 to form an inner hoop, the inner diverging leg 138 having a leg inner surface 140 which forms part of a ring inner surface 142. The ring inner surface 142 is configured to surround part of the horn 112 of the toilet 102. The multi-component ring 130 also has an outer diverging leg 144, which is attached to the continuous region 134 to form an outer hoop, the outer diverging leg 144 having a leg outer surface 146 which forms part of a ring outer surface 148 which is spaced apart from the ring inner surface 142. This outer diverging leg 144, when compressed by the flange upper surface 122, provides a biasing force to assist in sealing the ring inner surface 142 against the horn 112.

The radius r of curvature (denoted in FIGS. 7 and 8) between the substantially planar ring upper surface 136 and the ring inner surface 142 is preferably between about ⅛ inches (3 mm) and ⅕ inches (5 mm) to assure a good fit with the horn 112 of the toilet 102. This assists in distributing the force applied by the outer diverging leg 144.

The inner diverging leg 138 has a mean thickness $t_{inner}$ (shown in FIG. 7), and terminates an inner leg free end 150 which forms an inner part 152 of a substantially planar lower ledge 154, as best shown in FIG. 8. The outer diverging leg 144 has a mean thickness $t_{outer}$ (also shown in FIG. 7), and terminates in an outer leg free end 156 which forms an outer part 158 of the substantially planar lower ledge 154. Again, the ring lower ledge 154 is separated from the ring upper surface 136 by a separation distance S (shown in FIGS. 5 and 8). The inner part 152 and the outer part 158 of the substantially planar ring lower ledge 154 are separated by a groove 160 which extends upwardly from the ring lower ledge 154 into the ring 130. The groove 160 has a substantially triangular cross section with a groove depth D and a groove breadth B. It is the groove 160 that distinguishes the cross section of the ring 130 from that of the ring 24' shown in FIG. 3. It is preferred that the groove 160 reside within the footprint of the ring upper surface 136 to enhance the stability of the gasket 104 when being compressed between the toilet 102 and the closet flange 106. The groove 160 enhances the compressibility of the ring 130 while still assuring sealing with respect to the flange upper surface 122 and the horn 112. To allow substantial variation in the position of the closet flange 106 with respect to the subfloor 116 to which the closet flange 106 is mounted, it is preferred that the separation distance S be between about 0.6 inch (15 mm) and 0.8 inch (20 mm) and that the hardness of the material from which the ring 130 is constructed be maintained below about 35 durometer (Shore A±5).

It is further preferred that the groove depth D be maintained between about 60% to 80% of the separation distance S. It is also preferred that the groove breadth B be maintained between 30% and 40% of the groove depth D, and that the mean thickness $t_{inner}$ of the inner diverging leg 138 be greater than the mean thickness $t_{outer}$ of the outer diverging leg 144. It is further preferred that the substantially triangular cross section of the groove 160 be matched to the inclination of the leg inner surface 140 and the leg outer surface 146 so that the inner diverging leg 138 and the outer diverging leg 144 have constant thicknesses. The multi-component ring 130 can be fabricated as an integral unit, such as by injection molding.

The outer diverging leg 144, when it has a mean thickness $t_{outer}$ of at least about 3/16 inch (5 mm) and more preferably ¼ inch (6 mm), provides significant additional support the substantially planar ring upper surface 136 as well as increased pressure of the ring inner surface 142 against the horn 112 to enhance the sealing capacity of the ring 130. However, this increased sealing is accomplished at the expense of decreased deformability of the resulting ring 130 when compared to a ring which lacks an outer diverging leg.

It is preferred for the ring outer surface 148, which defines the outward limit of the ring lower ledge 154, to be positioned such that the ring lower ledge 154 is not superimposed on the metal flange extension 126 of the closet flange 106 when the gasket 104 is placed thereon, to avoid obstructing the mounting bolts 128.

The annular extension 132 is a protrusion on the inner part 152 of the substantially planar lower ledge 154, and can be formed integrally with the ring 130 when the gasket 104 is formed by injection molding. Alternatively, the components of ring 130 and the annular extension 132 can be formed as separate elements and bonded together, particularly when these elements are fabricated from a closed cell foam material. The annular extension 132 is bounded by an extension inner surface 168 and an extension outer surface 170. The extension inner surface 168 preferably serves to extend the ring inner surface 142 in a continuous manner, while the extension outer surface 170 intersects the inner part 152 of the ring lower ledge 154 and is positioned to engage the central opening sidewall 124 of the closet flange 106.

The deformability of the ring 130 allows a large degree of variation in the vertical position of the toilet 102 with respect to the closet flange 106 when the toilet 102 is installed. As shown in FIGS. 5 and 6, the closet flange 106 illustrated is mounted to the subfloor 116, which is illustrated as being covered with a finish floor 172, such as linoleum or tile, having a floor surface 174. Alternatively, when no finish floor 172 is employed, the subfloor 116 provides the floor surface 174 upon which the skirt 110 of the toilet base 108 rests. Thus, the height H of the flange upper surface 122 relative to the finish surface 174 (shown in FIG. 6) varies according to whether the finish floor 172 is employed and, if so, the thickness of the finish floor 172. The deformability of the ring 130 allows it to form a seal between the toilet base 108 and the closet flange 106 over a wide range of variation in the relative height H of the flange upper surface 122. When the toilet 102 is installed, the ring 130 is compressed to reduce the separation distance S (illustrated in FIG. 5) to a reduced separation distance S' (illustrated in FIG. 6) as the mounting bolts 128 are tightened to bring the skirt 110 of the toilet base 108 onto the floor surface 172. Preferably, the ring 130 is sufficiently compressible that the reduced separation distance S' can be as small as about ½ the original separation distance S. The groove 160 allows the ring inner surface 144 and the ring outer surface 148 to bow as shown in FIG. 6, thus increasing the collapseability of the ring upper surface 136 with respect to the ring lower ledge 154 and allowing the separation therebetween to be reduced by a reduction in separation ΔS.

It should also be apparent that, as discussed earlier, if the flange upper surface 122 is tilted with respect to the subfloor 116, variation in the separation distance S' between the flange upper surface 122 will vary at different locations around the toilet base 108. Again, the limited coverage of the flange upper surface 122 by the ring lower ledge 154 in combination with the resiliency of the ring 130 can provide accommodation for such tilting while maintaining an adequate seal between the pertinent surfaces.

As can be seen in FIG. 6, the flange upper surface 122 engages the ring lower ledge 154 and the annular extension 132 engages a portion of the central opening sidewall 124 of the central opening 118 when the toilet 102 is installed, thereby stabilizing the gasket 104 when the toilet 102 is mounted onto the closet flange 106. The groove 160 assists in assuring a seal between the toilet 102 and the gasket 104 by allowing the ring 130 to more readily conform to the shape of the horn 112, thereby increasing the sealing area. Additionally, dividing the ring lower ledge 154 into the inner part 152 and the outer part 158 provides redundant independent surfaces for sealably engaging the flange upper surface 122.

Figure 9:
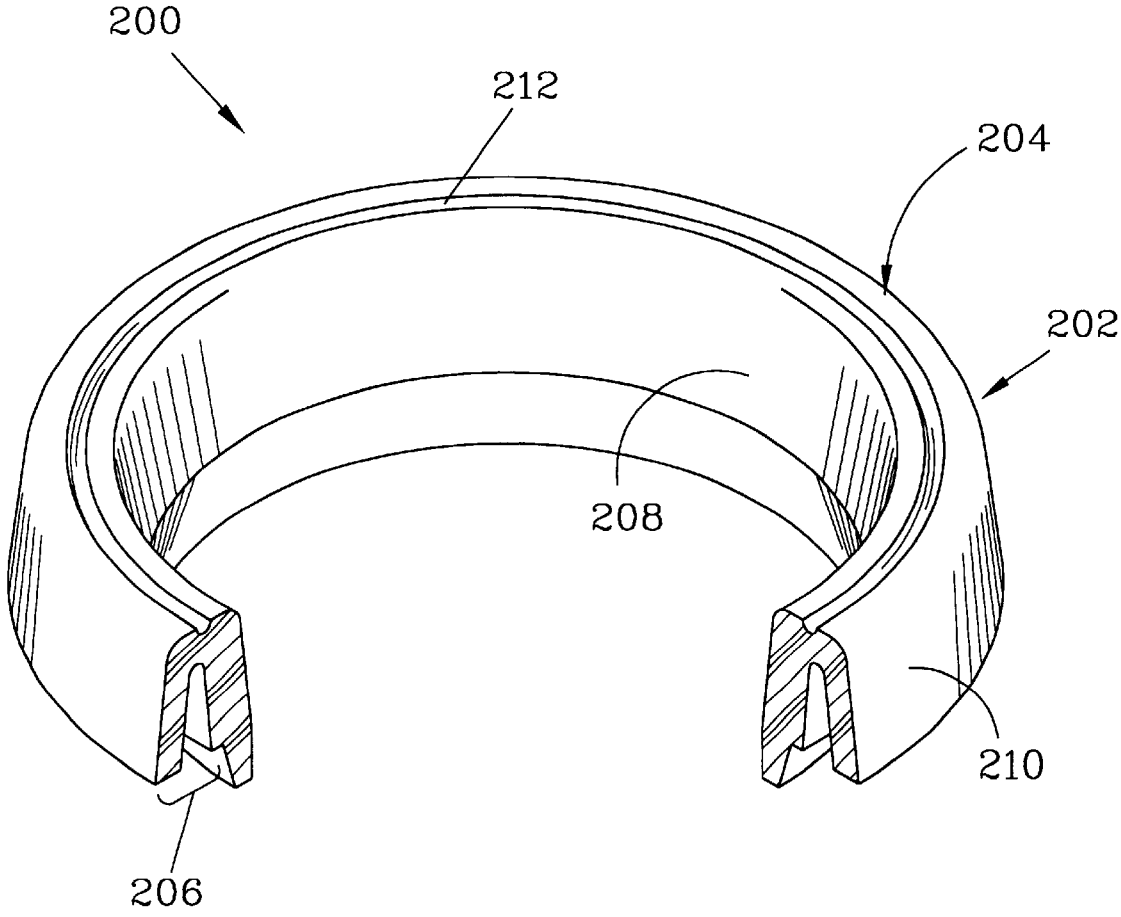
FIG. 9 is a section view of a gasket similar to that shown in FIG. 5, but which has a concentric indentation in the ring upper surface to provide enhanced compliance with the surface of the toilet base with which it engages.

FIG. 9 is an isomeric view of a gasket 200 which is similar to the gasket 104. The gasket 200 again has a ring 202 bounded by a substantially planar ring upper surface 204, a substantially planar ring lower ledge 206, a ring inner surface 208, and a ring outer surface 210. The ring 202 differs in that the substantially planar ring upper surface 204 has a concentric indentation 212 which aids in the compliance of the substantially planar upper ring surface 204 to a toilet base (not shown).

One example of the gasket 200 employing the multi-component structure for the ring 202 was fabricated from a neoprene material having a durometer hardness of 25–30, a tensile strength of 600 lbs., and an elongation of 400% and was found to be effective in providing a seal.

While the novel features of the present invention have been described in terms of particular embodiments and preferred applications, it should be appreciated by one skilled in the art that substitution of materials and modification of details obviously can be made without departing from the spirit of the invention.

What we claim is:

1. A gasket for positioning between a toilet base and a conventional closet flange to form a seal therebetween, the toilet base having a downwardly extending horn surrounded by a substantially planar toilet lower surface and the closet flange having a central opening surrounded by a substantially planar flange upper surface, the gasket comprising:

a water impermeable elastomer ring bounded by a substantially planar ring upper surface, a substantially planar ring lower ledge that is spaced apart from said substantially planar ring upper surface by a separation distance S, a ring inner surface configured to surround a portion of the horn of the toilet base when the horn is placed therein, and a ring outer surface spaced apart from said ring inner surface, and wherein said ring is quasi trapezoidal in cross section, being essentially trapezoidal with a groove extending upward from said substantially planar ring lower ledge, said ring having, an upper continuous region extending downwardly from said substantially planar ring upper surface, an inner diverging leg attached to said upper continuous region and having an inner leg free end, and an outer diverging leg attached to said upper continuous region and having an outer leg free end, the cross section of said ring having a maximum thickness $T_{max}$ at said substantially planar ring lower ledge, said inner leg free end and said outer leg free end defining said substantially planar ring lower ledge, said inner diverging leg and said outer diverging leg diverging such as to form said groove therebetween, said groove extending upwardly from said substantially planar ring lower ledge into said ring and having a groove depth D, and said separation distance S being at least about ½ inch (13 mm) to assure that said water impermeable elastomer ring is compressed when the toilet base is mounted to the closet flange with said ring interposed therebetween; and an annular extension forming a protrusion on said substantially planar ring lower ledge, said annular extension having en extension outer surface extending from said substantially planar ring lower ledge and configured to be insertable into the central opening of the closet flange such that, when so inserted, said substantially planar lower ledge of said ring abuts the substantially planar flange upper surface of the closet flange, said annular extension also having an extension inner surface which is spaced apart from said extension outer surface.

2. The gasket of claim 1 wherein said separation distance S is between about 0.6 and 0.8 inches (15 mm–20 mm).

3. The gasket of claim 2 wherein said resilient material is a fully dense elastomer which is substantially free of distributed cavities.

4. The gasket of claim 3 wherein said fully dense elastomer is a neoprene material having a durometer of between about 25 and 35 (Shore A±5).

5. The gasket of claim 4 wherein said groove depth D is between about 60% to 80% of said separation distance S.

6. The gasket of claim 5 wherein said maximum thickness $T_{max}$ is at least about 80% of said separation distance S.

7. The gasket of claim 6 wherein said groove has a groove breadth B that is about 30% to 40% of said groove depth D, and further wherein said groove is positioned so as to lie substantially within the footprint of said substantially planar ring upper surface.

8. The gasket of claim 7 further comprising:

a concentric indentation in said substantially planar ring upper surface.

9. The gasket of claim 8 wherein said ring inner surface is substantially continuous with said extension inner surface.

10. A gasket for positioning between a toilet base and a conventional closet flange to form a seal therebetween, the toilet base having a downwardly extending horn surrounded by a substantially planar toilet lower surface and the closet flange being configured for mounting to a floor and joining to a drainpipe and having a central opening surrounded by a substantially planar flange upper surface having mounting bolts engaged therein and spaced apart by a bolt separation distance $D_b$, the gasket comprising:

a water impermeable elastomer ring having a ring diameter $D_b$ which is less than the bolt separation distance $D_b$, said ring being bounded by a substantially planar ring upper surface, a substantially planar ring lower ledge that is spaced apart from said substantially planar ring upper surface by a separation distance S, a ring inner surface configured to surround a portion of the horn of the toilet base when the horn is placed therein, and a ring outer surface spaced apart from said ring inner surface, and wherein said ring is quasi trapezoidal in cross section, being essentially trapezoidal with a groove extending upward from said substantially planar ring lower ledge, said ring having, an upper continuous region extending downwardly from said substantially planar ring upper surface, an inner diverging leg attached to said upper continuous region and having an inner leg free end, and an outer diverging leg attached to said upper continuous region and having an outer leg free end, the cross section of said ring having a maximum thickness $T_{max}$ at said substantially planar ring lower ledge, said inner leg free end and said outer leg free end defining said substantially planar ring lower ledge, said inner diverging leg and said outer diverging leg diverging such as to form said groove therebetween, said groove extending upwardly from said substantially planar ring lower ledge into said ring and having a groove depth D, and said separation distance S being at least about ½ inch (13 mm) to assure that said water impermeable elastomer ring is compressed when the toilet base is mounted to the closet flange with said ring interposed therebetween; and an annular extension forming a protrusion on said substantially planar ring lower ledge, said annular extension having an extension outer surface extending from said substantially planar ring lower ledge and configured to be insertable into the central opening of the closet flange such that, when so inserted, said substantially planar lower ledge of said ring abuts the substantially planar flange upper surface of the closet flange, said annular extension also having an extension inner surface which is spaced apart from said extension outer surface.

11. The gasket of claim 10 wherein said separation distance S is between about 0.6 and 0.8 inches (15 mm–20 mm).

12. The gasket of claim 11 wherein said resilient material is a fully dense elastomer which is substantially free of distributed cavities.

13. The gasket of claim 12 wherein said fully dense elastomer is a neoprene material having a durometer of between about 25 and 35 (Shorn A±5).

14. The gasket of claim 13 wherein said groove depth D is between about 60% to 80% of said separation distance S.

15. The gasket of claim 14 wherein said maximum thickness $T_{max}$ is at least about 80% of said separation distance S.

16. The gasket of claim 15 wherein said groove has a groove breadth B that is about 30% to 40% of said groove depth D, and further wherein said groove is positioned so as to lie substantially within the footprint of said substantially planar ring upper surface.

17. The gasket of claim 16 further comprising:

a concentric indentation in said substantially planar ring upper surface.

18. The gasket of claim 17 wherein said ring inner surface is substantially continuous with said extension inner surface.

* * * * *